US007610654B2

(12) United States Patent
Lee et al.

(10) Patent No.: US 7,610,654 B2
(45) Date of Patent: Nov. 3, 2009

(54) VACUUM CLEANER

(75) Inventors: Jea Won Lee, Hwaseong-Si (KR); Jae Man Joo, Suwon-Si (KR); Jun Hwa Lee, Anyang-Si (KR); Tae Seok Yoon, Ahnyang-Si (KR); Seung Gee Hong, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 6 days.

(21) Appl. No.: 11/475,965

(22) Filed: Jun. 28, 2006

(65) Prior Publication Data

US 2007/0151072 A1 Jul. 5, 2007

(30) Foreign Application Priority Data

Dec. 30, 2005 (KR) ..... 10-2005-0134803

(51) Int. Cl.
*A47L 9/16* (2006.01)

(52) U.S. Cl. ..... 15/353; 15/326; 15/327.1; 15/327.7; 15/412

(58) Field of Classification Search ..... 15/353, 15/326, 412, 327.7, 327.1
See application file for complete search history.

(56) References Cited

U.S. PATENT DOCUMENTS 4,280,245 A 7/1981 Hiester
4,665,581 A 5/1987 Oberdorfer
5,159,738 A * 11/1992 Sunagawa et al. ..... 15/326
5,293,664 A * 3/1994 Lim et al. ..... 15/326
5,513,417 A * 5/1996 Kim et al. ..... 15/326
5,720,074 A * 2/1998 Lee ..... 15/326
5,894,629 A * 4/1999 Kim ..... 15/326
5,991,969 A * 11/1999 Lee ..... 15/326

(Continued)

FOREIGN PATENT DOCUMENTS

DE 41 00 858 7/1992

(Continued)

OTHER PUBLICATIONS

Russian Office Action issued Aug. 30, 2007 in corresponding Russian Patent Application No. 2006125254/12(027382).

(Continued)

*Primary Examiner*—Joseph J Hail, III
*Assistant Examiner*—Robert Scruggs
(74) *Attorney, Agent, or Firm*—Staas & Halsey LLP

(57) ABSTRACT

A vacuum cleaner having a discharge flow path, which reduces noise generated due to resistance of the flow path, and by a motor. The vacuum cleaner includes a body, a blower fan unit including a blower fan and a motor to generate suction force in the body, an inner case surrounding the blower fan unit and having an inner flow path formed therein, an outer case surrounding the inner case, and a discharge flow path formed between the inner case and the outer case to communicate with the inner flow path. The discharge flow path including a circulation flow path branched from the inner flow path to guide air discharged from the blower fan unit, and a bent flow path branched from the inner flow path to guide the air discharged from the blower fan unit, the air is thereby bent a number of times in the bent flow path.

18 Claims, 8 Drawing Sheets

U.S. PATENT DOCUMENTS

| | | | | |
|---|---|---|---|---|
| 6,094,774 | A * | 8/2000 | Larsen et al. | 15/326 |
| 2002/0032947 | A1* | 3/2002 | Oh et al. | 15/323 |
| 2007/0234504 | A1* | 10/2007 | Bott et al. | 15/347 |

FOREIGN PATENT DOCUMENTS

| | | |
|---|---|---|
| DE | 19739613 | 3/1998 |
| EP | 0 099 466 | 2/1984 |
| EP | 0 345 699 | 12/1989 |
| EP | 0 636 336 | 2/1995 |
| JP | 2001-087174 | 4/2001 |
| SU | 1602442 | 10/1990 |
| SU | 1743579 | 6/1992 |
| WO | 03/101271 | 12/2003 |
| WO | 2005/016107 | 2/2005 |

OTHER PUBLICATIONS

European Search Report issued Oct. 31, 2007 in corresponding European Patent Application No. 06013530.8-2316.

Chinese Office Action for corresponding Chinese Application 200610101979.7; issued Nov. 28, 2008.

* cited by examiner

VACUUM CLEANER

CROSS-REFERENCE TO RELATED APPLICATIONS

This application claims the benefit of Korean Patent Application No. 10-2005-0134803, filed on Dec. 30, 2005, in the Korean Intellectual Property Office, the disclosure of which is incorporated herein by reference.

BACKGROUND OF THE INVENTION

1. Field of the Invention

The present invention relates to a vacuum cleaner. More particularly, to a vacuum cleaner which enables reduction of noise generated from a discharge flow path and a motor.

2. Description of the Related Art

Generally, a vacuum cleaner is an apparatus which cleans a room in such a manner that foreign matter such as dust is drawn along with air into a body by generating suction force, and removed through a dust collection unit and the like within the body.

In FIG. 1, a conventional vacuum cleaner includes a body 1 defining an outer appearance, a blower fan unit 2 positioned within the body 1 to generate suction force, and a dust collection unit 3 to filter foreign matter from air drawn into the body 1. The conventional vacuum cleaner generates a suction force by the blower fan unit 2, to draw foreign matter such as dust along with air into the body 1, and only the air is discharged to an outside of the body 1 by filtering the foreign matter in the air via the dust collection unit 3 positioned in the body 1, to thereby cleaning a room.

The blower fan unit 2 of the conventional vacuum cleaner includes a blower fan 2*a*, to generate the suction force while rotating, and a motor 2*b* to rotate the blower fan 2*a*. The blower fan unit 2 is surrounded by an inner case 8. The blower fan 2*a* and the motor 2*b* are positioned to have a rotational axis disposed longitudinally in a front and a rear direction, such that air is drawn in from a front side of the inner case 8, and is discharged to a rear side of the inner case 8. The inner case 8 is surrounded by an outer case 7 such that a discharge flow path 6 is defined therebetween. After being discharged to the rear side, the air is guided along the discharge flow path 6, passes through a discharged-air filter 5, and is then discharged to the outside of the body 1 via an air vent 4 positioned at a rear upper portion of the body 1.

In the conventional vacuum cleaner, since the discharge flow path 6 does not have a sufficient area, a large amount of resistance of a flow path is generated when air discharged from the blower fan unit 2 passes through the discharge flow path 6. Accordingly, the air discharged from the blower fan unit 2 builds up in the discharge flow path 6, so that load is exerted on the motor 2*b* of the blower fan unit 2, causing severe noise.

In addition, since the discharge flow path 6 does not have a sufficient length, there is a problem in that noise generated from the motor 2*b* is directly transferred through the air vent 4.

SUMMARY OF THE INVENTION

Accordingly, it is an aspect of the present invention to provide a vacuum cleaner having a sufficient area of a discharge flow path, to enable a reduction in noise generated from the discharge flow path.

It is another aspect of the present invention to provide the vacuum cleaner having the sufficient area of the discharge flow path, to sufficiently reduce noise generated from a motor through the discharge flow path.

Additional aspects and/or advantages of the invention will be set forth in part in the description which follows and, in part, will be apparent from the description, or may be learned by practice of the invention.

The foregoing and/or other aspects of the present invention are achieved by providing a vacuum cleaner including a body defining an outer appearance thereof, a blower fan unit including a blower fan and a motor to generate suction force in the body, an inner case surrounding the blower fan unit and including an inner flow path formed therein, an outer case surrounding the inner case, and a discharge flow path formed between the inner case and the outer case, to communicate with the inner flow path, wherein the discharge flow path includes a circulation flow path branched from the inner flow path, to guide circulation of air discharged from the blower fan unit, and a bent flow path branched from the inner flow path, to guide the air discharged from the blower fan unit such that the air is bent a number of times in the bent flow path.

The inner case includes a lower case having a semi-cylindrical shape centered on a rotational shaft of the blower fan unit, to support a lower portion of the blower fan unit, and an upper case coupled with the lower case to form the inner case, the upper case including a cylindrical part having a same radius as that of the lower case, and an extended part extending from the cylindrical part, and having a larger radius than that of the cylindrical part.

The extended part includes a connection flow path formed on an inner side thereof, to connect the inner flow path with the discharge flow path.

The cylindrical part includes an end engaging with a first side end of the lower case, and the extended part may have an end engaging with a first side of the outer case such that a branch part is formed between a second side end of the lower case, and an end of the extended part of the upper case to divide air flowing in the connection flow path into the circulation flow path and the bent flow path.

The circulation flow path includes a spiral flow path formed in a circumferential direction along an outer peripheral surface of the inner case from the branch part.

The bent flow path includes a first flow path communicated with the branch part, while extending in a rear direction, a second flow path communicated with the first flow path while being defined between a rear side of the inner case and a rear side of the outer case, and a third flow path communicated with the second flow path while extending in a front direction.

Air flow may be branched at the branch part into a first air flow circulating along the circulation flow path, and a second air flow bent along the bent flow path, wherein the first air flow and the second air flow form a combined flow which rises at an opposite side of the branch part around the inner case.

The outer case includes an outflow port formed at a rear upper portion, to allow air to flow out therethrough, and including a first partition positioned above the bent flow path to prevent direct outflow of the second air flow through the outflow port, and a second partition positioned above the inner case to prevent direct outflow of the combined flow through the outflow port.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
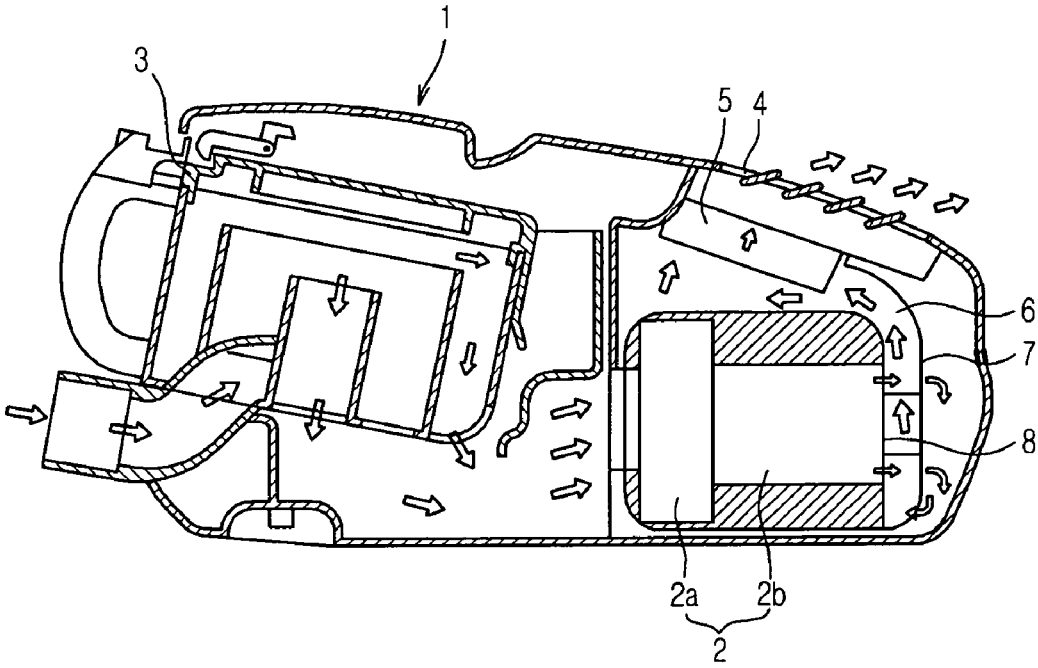
PRIOR ART FIG.1
FIG. 1 is a longitudinal cross-sectional view illustrating a body of a conventional vacuum cleaner.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
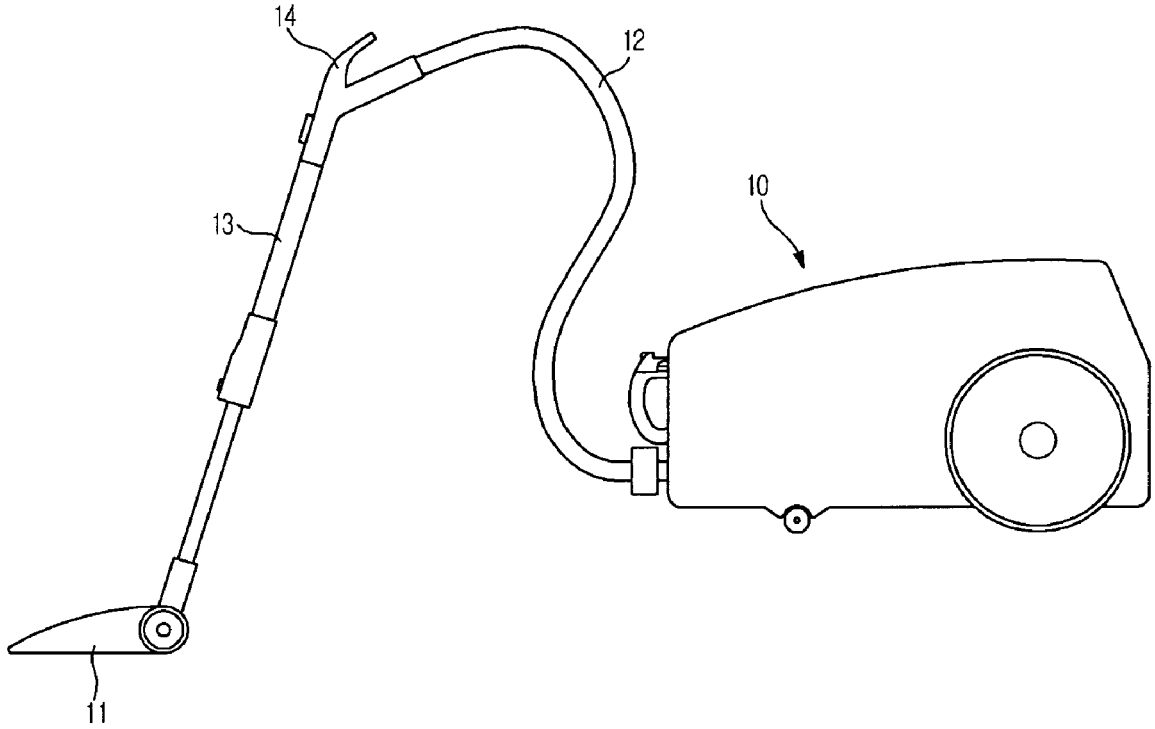
FIG. 2 is a view illustrating a vacuum cleaner in accordance with an embodiment of the present invention.

In FIG. 2, a vacuum cleaner according to an embodiment of the present invention comprises a suction unit 11, to suck foreign matter together with air via suction force, and a body 10 to collect the foreign matter suctioned by the suction unit 11.

The body 10 and the suction unit 11 are connected via a connection hose 12 and a connection pipe 13, wherein the suction force generated from the body 10 is transferred to the suction unit 11 therethrough. The vacuum cleaner further comprises a handle 14 between the connection hose 12 and the connection pipe 13 to be gripped by a user when using the vacuum cleaner.

The connection hose 12 comprises a stretchable corrugated pipe and the like. The connection hose 12 is connected at one end with the body 10, and at the other end with the handle 14, wherein the suction unit 11 can be freely moved in a predetermined radius around the body 10. The connection pipe 13 comprises a predetermined length, and is connected at one end with the suction unit 11 while being connected at the other end with the handle 14 to allow the user to clean the floor using the vacuum cleaner while standing on the floor.

Figure 3:
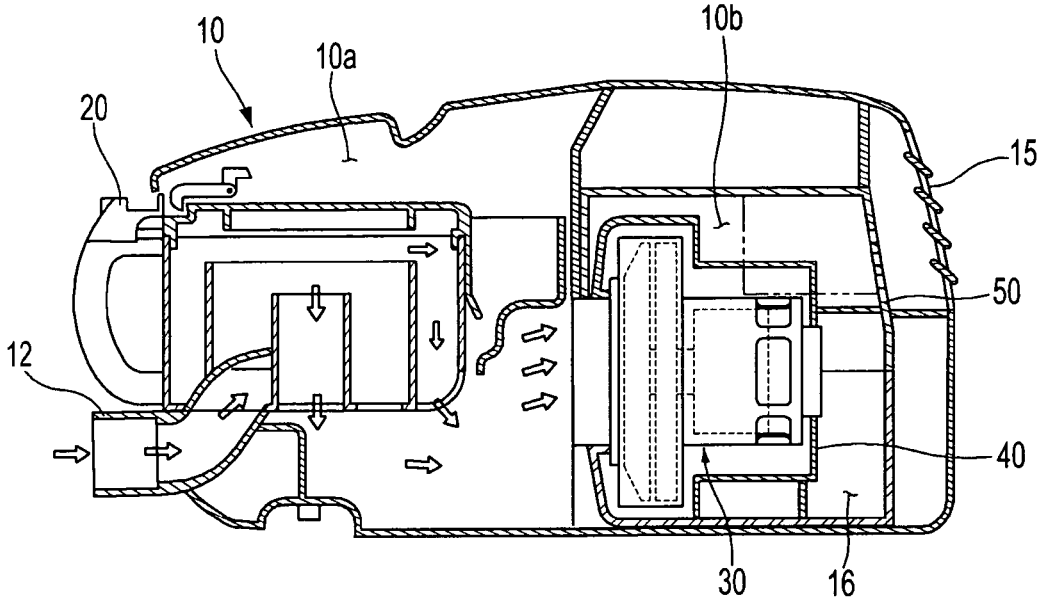
FIG. 3 is a longitudinal cross-sectional view illustrating a body of the vacuum cleaner shown in FIG. 2.

In FIG. 3, the body 10 is connected at a front side with the connection hose 12, to allow air to flow thereto through the connection hose 12, and comprises an air vent 15 at a rear upper portion through which after having the foreign matter removed via a dust collection unit 20 in the body 10, the air is discharged to an outside of the body 10.

The body 10 further comprises a dust collection compartment 10*a* at a front side thereof, the dust collection compartment 10*a* having the dust collection unit 20 positioned therein, and a suction compartment 10*b* at a rear side thereof, the suction compartment 10*b* comprising a blower fan unit 30 and a discharge flow path 16 positioned therein.

The structure of the blower fan unit 30 and the discharge flow path 16 positioned in the suction compartment 10*b* will now be described with reference to FIGS. 4 through 8.

Figure 4:
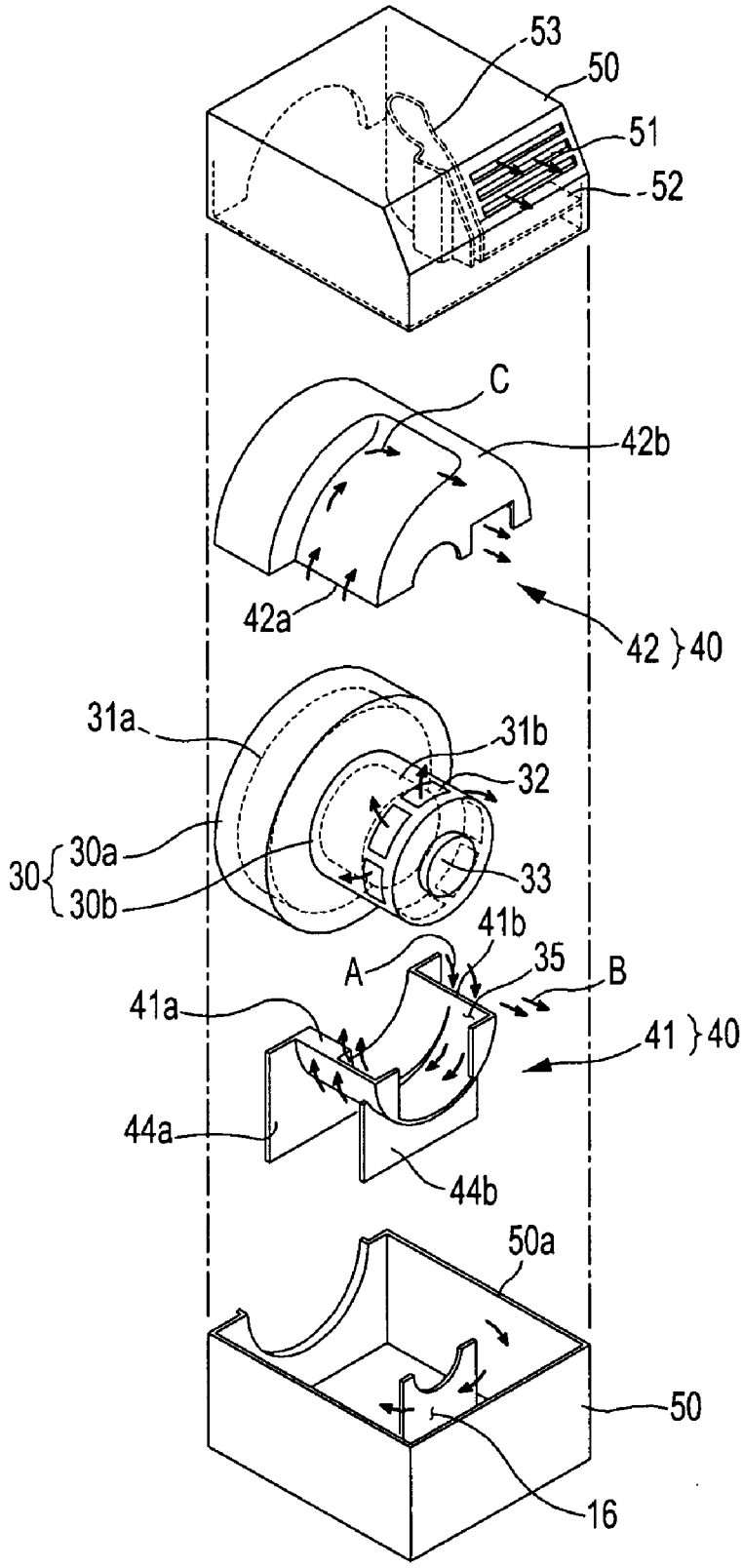
FIG. 4 is an exploded perspective view illustrating the vacuum cleaner shown in FIG. 3, in which inner and outer cases surround a blower fan unit within the body.
Figure 5:
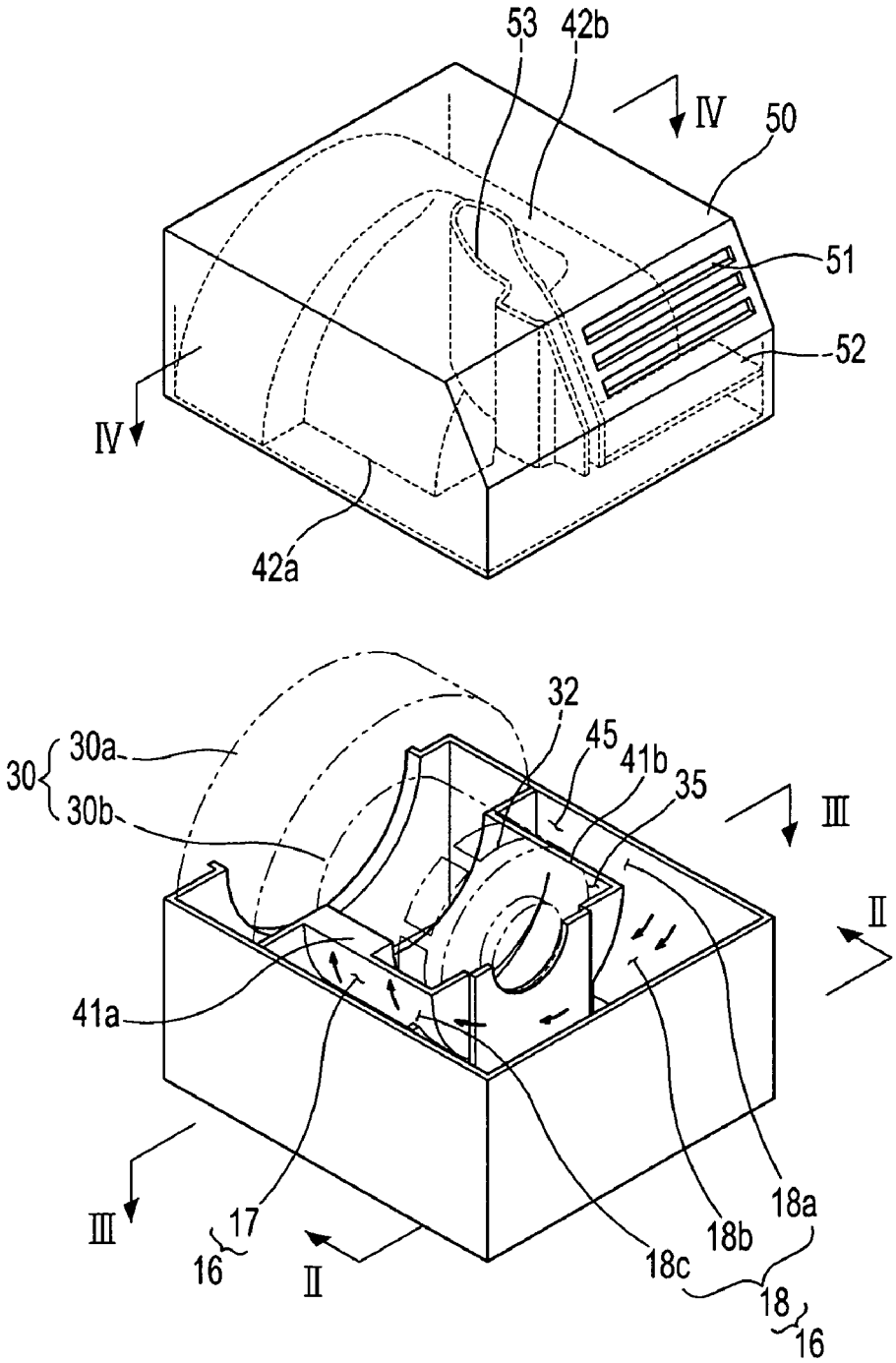
FIG. 5 is a partially assembled view of the vacuum cleaner shown in FIG. 4.

In FIGS. 4 and 5, the blower fan unit 30 positioned in the suction compartment 10*b* comprises a blowing part 30*a* in which a blower fan 31*a* is positioned to generate a suction force, and a motor part 30*b* in which a motor 31*b* is positioned to rotate the blower fan 31*a*.

In the blower fan unit 30, the blower fan 31*a* sucks air in an axial direction, and discharges in a radial direction. Then, the air discharged from the blower fan 31*a* cools the motor 31*b*, and is discharged radially through a plurality of discharge holes 32 formed around an outer peripheral surface of the motor part 30*b*.

The blower fan unit 30 is surrounded by a substantially cylindrical inner case 40 such that an inner flow path 35 is defined between the inner case 40 and the motor part 31*b*, to allow the air discharged through the discharge holes 32 to flow therethrough. The inner case 40 is surrounded by an outer case 50 such that the discharge flow path 16 is defined between an outer face of the inner case 40 and an inner face of the outer case 50 to guide the air discharged from the inner case 40 towards the air vent 15 of the body 10.

The inner case 40 is formed by coupling a lower case 41 having an open upper portion to support a lower portion of the blower fan unit 30 to an upper case 42 having an open lower portion to cover an upper portion of the blower fan unit 30. The lower case 41 is supported on the outer case 50 by a front side supporting portion 44*a*, which supports a front side of the lower case 41, and by a rear side supporting portion 44*b* which supports a rear side of the lower case 41.

The lower case 41 comprises a semi-cylindrical shape centered on a rotational shaft 33 of the blower fan unit 30. The upper case 42 coupled with the lower case 41 comprises a biased semi-cylindrical shape around the rotational shaft 33 of the blower fan unit 30. The upper case 41 further comprises a cylindrical part 42*a* having the same radius as that of the lower case 41, and an extended part 42*b* extending from the cylindrical part 42*a* and having a larger radius than that of the cylindrical part 42*a*. The extended part 42*b* comprises a connection flow path 36 formed on an inner side thereof to connect the inner flow path 35 with the discharge flow path 16, as shown in FIG. 6.

For the upper case 42, an end of the cylindrical part 42*a* engages with a first side end 41*a* of the lower case 41, and an end of the extended part 42*b* engages with a first side 50*a* of the outer case 50. Thus, a branch part 45 is formed between a second side end 41*b* of the lower case 41 and the end 42*b* of the extended part 42*b* of the upper case 42, to divide air flowing in the connection flow path 36 into a circulation flow path 17 and a bent flow path 18 which constitute the discharge flow path 16.

The discharge flow path 16 guides air discharged from the branch part 45 towards the air vent 15, and is branched into the circulation flow path 17 which guides circulation of the air discharged from the branch part 45, and the bent flow path 18 which guides the air discharged from the branch part 45 to flow while being bent a number of times therein. The circulation flow path 17 and the bent flow path 18 will be described with reference to FIGS. 6, 7 and 8, in which FIG. 6 is a cross-sectional view taken along line II of FIG. 5, FIG. 7 is a cross-sectional view taken along line III of FIG. 5, and FIG. 8 is a cross-sectional view taken along line IV of FIG. 5.

Figure 6:
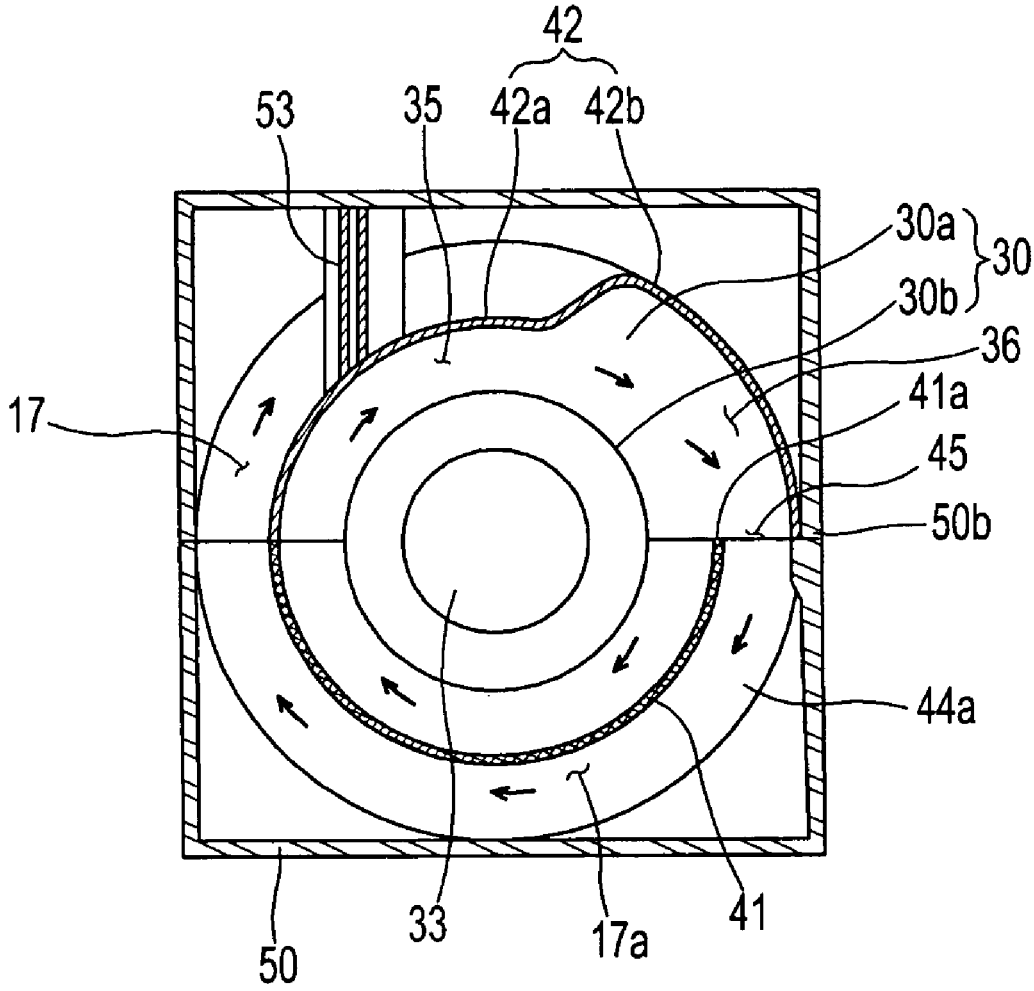
FIG. 6 is a cross-sectional view taken along line II of FIG. 5.

The circulation flow path 17 comprises a spiral flow path formed circumferentially along the outer peripheral surface of the inner case 40 from the branch part 45, as shown in FIG. 6. The circulation flow path 17 comprises the biased cylindrical shape, and the lower side of the lower case 41 is supported by the front side supporting portion 44*a* and the rear side supporting portion 44*b* while being spaced a predetermined distance from the outer case 50.

Figure 7:
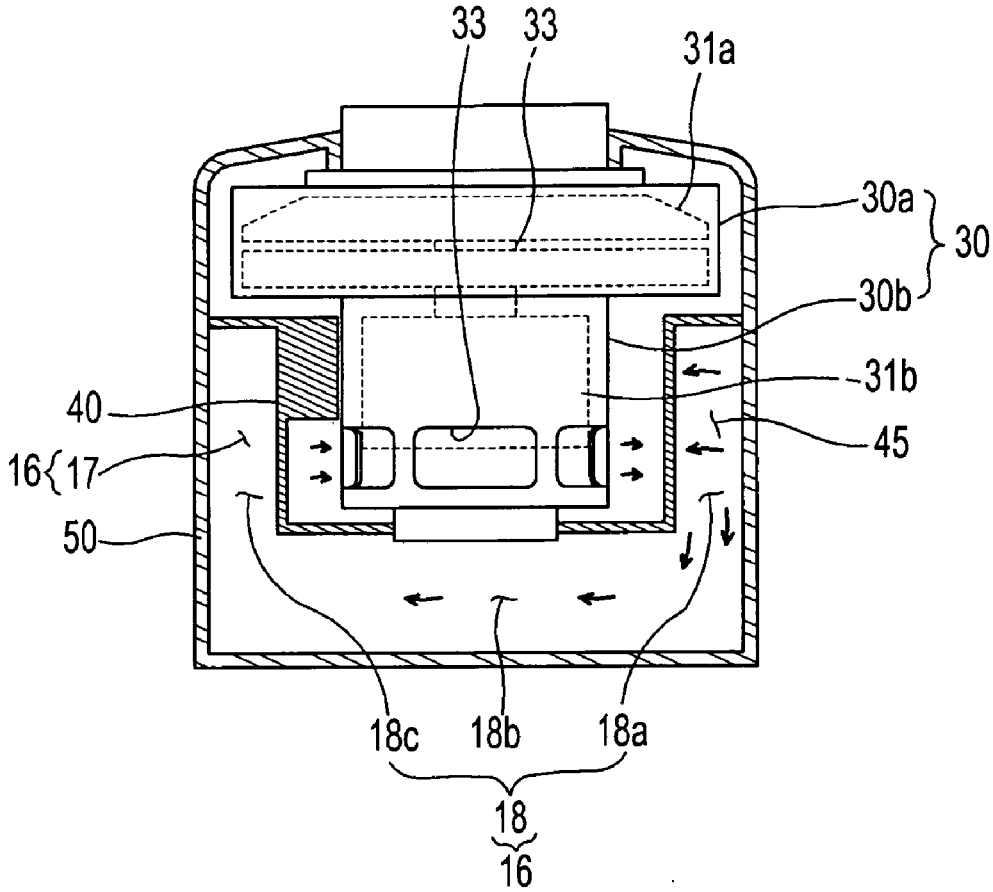
FIG. 7 is a cross-sectional view taken along line III of FIG. 5.
Figure 8:
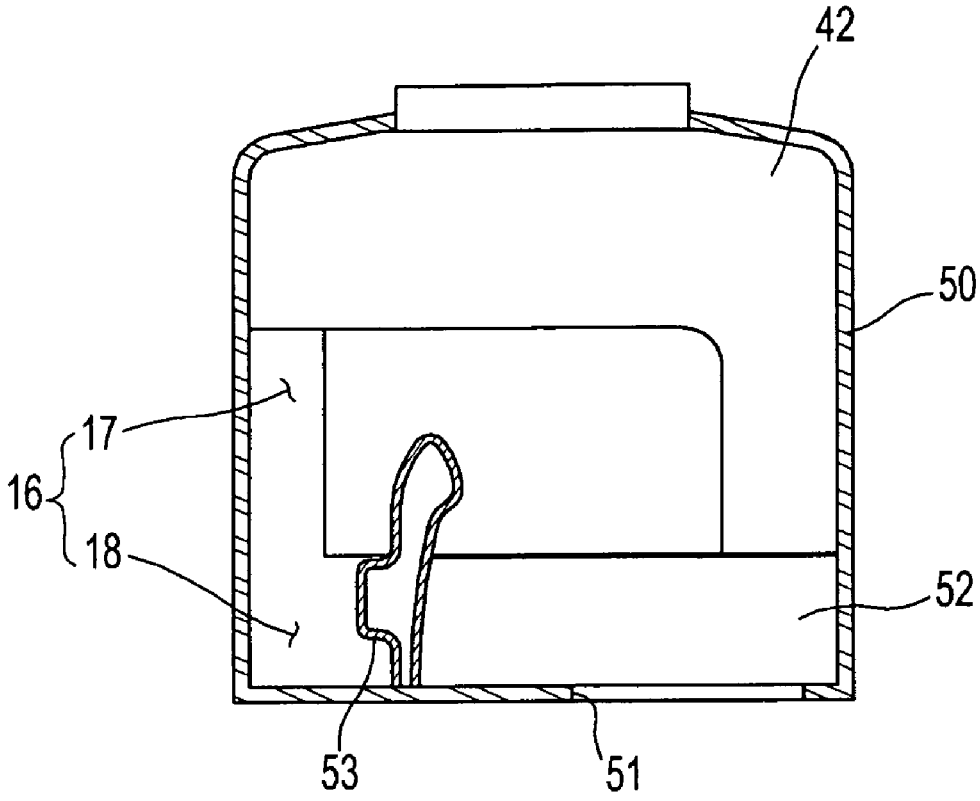
FIG. 8 is a cross-sectional view taken along line IV of FIG. 5.

In FIG. 7, the bent flow path 18 comprises a first flow path 18*a* communicated with the branch part 45 while extending in a rear direction in parallel to the rotational shaft 33 of the blower fan unit 30, a second flow path 18*b* communicated with the first flow path 18*a* while being defined between a rear side of the inner case 40 and a rear side of the outer case 50, and a third flow path 18*c* communicated with the second flow path 18*b* while extending in a front direction in parallel to the rotational shaft 33 of the blower fan unit 30.

In the structure of the circulation flow path 17 and the bent flow path 18 as described above, air flowing in the discharge flow path 16 is branched at the branch part 45 into a first air flow A circulating along the circulation flow path 17, and a second air flow B bent along the bent flow path 18 (see FIG. 4, for example). Here, the first air flow A and the second air flow B are combined to form a combined flow C which rises at an opposite side of the branch part 45 around the inner case 40.

As such, since air is branched at the branch part 45, and divided into the circulation flow path 17 and the bent flow path 18 constituting the discharge flow path 16, resistance of the flow path to the air discharged through the discharge flow path 16 is remarkably reduced.

After being guided along the discharge flow path 16, air is discharged to an outside of the vacuum cleaner through the air vent 15 of the body via an outflow port 51 formed at the rear upper portion of the outer case 50.

In FIG. 8, the outer case 50 is provided with a first partition 52 above the second flow path 18*b* to prevent the second air flow B from rising and being directly discharged through the outflow port 51 before the second air flow B forms the combined flow C together with the first air flow A.

In addition, the outer case 50 is provided with a second partition 53 above the inner case 40, to prevent direct outflow of the combined air flow C of the first air flow A and the second air flow B through the outflow port 51.

With the first and second partitions 52 and 53, the discharge flow path 16 from the branch part 45 to the air vent 15 of the body 10 is further extended.

As described above, since the circulation flow path 17 of the discharge flow path 16 has the spiral shape, and the bent flow path 18 thereof is bent a number of times, the discharge flow path 16 has an extended length. Accordingly, even though noise is generated from the motor 31*b*, the noise is sufficiently reduced via the discharge flow path 16.

As apparent from the above description, the vacuum cleaner according to the present invention includes the discharge flow path comprising the circulation flow path and the bent flow path, so that a sufficient area of the discharge flow path is secured, thereby allowing reduction of noise generated due to resistance of the flow path to air flowing therein.

In addition, since the discharge flow path has a sufficiently extended length, it is possible to sufficiently reduce noise generated from the motor.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A vacuum cleaner comprising:

a body defining an outer appearance thereof;

a blower fan unit comprising a blower fan and a motor to generate a suction force in the body;

an inner case surrounding the blower fan unit and comprising an inner flow path formed therein;

an outer case surrounding the inner case; and a discharge flow path formed between the inner case and the outer case to communicate with the inner flow path, wherein the discharge flow path comprises:

a circulation flow path branched from the inner flow path to guide circulation of air discharged from the blower fan unit, and a bent flow path branched from the inner flow path to guide the air discharged from the blower fan unit in a direction substantially perpendicular to a direction of air circulated through the circulation flow path such that the air is bent a number of times in the bent flow path, and wherein the inner case includes a lower case to support a lower portion of the blower fan unit, and an upper case coupled to the lower case, the upper case including a cylindrical part having a same radius as that of the lower case, and an extended part extending from the cylindrical part and having a larger radius than that of the cylindrical part, the circulation flow path and the bent flow path being branched from an inner side of the extended part and being joined with each other at an outer side of the cylindrical part.

2. The vacuum cleaner according to claim 1, wherein the lower case has a semi-cylindrical shape centered on a rotational shaft of the blower fan unit.

3. The vacuum cleaner according to claim 1, wherein the extended part comprises a connection flow path formed on an inner side thereof, to connect the inner flow path with the discharge flow path.

4. The vacuum cleaner according to claim 3, wherein the cylindrical part includes an end engaging with a first side end of the lower case, and the extended part includes an end engaging with a first side of the outer case to form a branch part between a second side end of the lower case and an end of the extended part of the upper case to divide air flowing in the connection flow path into the circulation flow path and the bent flow path.

5. The vacuum cleaner according to claim 4, wherein the circulation flow path comprises a spiral flow path formed in a circumferential direction along an outer peripheral surface of the inner case from the branch part.

6. The vacuum cleaner according to claim 4, wherein the bent flow path comprises: a first flow path communicated with the branch part while extending in a rear direction; a second flow path communicated with the first flow path while being defined between a rear side of the inner case and a rear side of the outer case; and a third flow path communicated with the second flow path while extending in a front direction.

7. The vacuum cleaner according to claim 4, wherein air flow is branched at the branch part into a first air flow circulating along the circulation flow path and a second air flow bent along the bent flow path, the first air flow and the second air flow forming a combined flow combined and rising at an opposite side of the branch part around the inner case.

8. The vacuum cleaner according to claim 7, wherein the outer case comprises an outflow port formed at a rear upper portion to allow air to flow out therethrough, and the outflow port comprises a first partition positioned above the bent flow path, to prevent direct outflow of the second air flow through the outflow port, and a second partition positioned above the inner case to prevent direct outflow of the combined flow through the outflow port.

9. A vacuum cleaner including a body, comprising:

a blower fan unit comprising a blower fan and a motor to generate a suction force in the vacuum cleaner;

an inner case which surrounds the blower fan unit and comprises an inner flow path defined between the inner case and the motor, to circulate air discharged radially from the blower fan unit; and an outer case which surrounds the inner case and is housed within the body of the vacuum cleaner, wherein a discharge flow path is formed between the inner case and the outer case, to discharge air to an outside of the vacuum cleaner, and wherein the discharge flow path includes a circulation flow path and a bent flow path which are branched from the inner flow path, one portion of air being guided to the circulation flow path from the inner flow path to flow circularly, the other portion of the air being guided to the bent flow path from the inner flow path in a direction substantially perpendicular to a direction of air circulated through the circulation flow path to flow in a repeatedly bent manner in the bent flow path and then joining the one portion of air guided to the circulation flow path before being discharged from the outer case.

10. The vacuum cleaner according to claim 9, wherein the blower fan unit further comprises a plurality of holes formed on an outer peripheral surface of the blower fan unit surrounding the motor, to radially discharge air therethrough, from the blower fan.

11. The vacuum cleaner according to claim 9, wherein the inner case comprises:

a lower case having a semi-cylindrical shape centered on a rotational shaft of the blower fan unit to support a lower portion of the blower fan unit; and an upper case coupled with the lower case to form the inner case, wherein the upper case comprises a cylindrical part having a same radius as that of the lower case, and an extended part extending from the cylindrical part and having a larger radius than that of the cylindrical part.

12. The vacuum cleaner according to claim 11, wherein the extended part comprises a connection flow path formed on an inner side thereof, to connect the inner flow path with the discharge flow path.

13. The vacuum cleaner according to claim 12, wherein the cylindrical part comprises an end engaging with a first side end of the lower case, and the extended part comprises an end engaging with a first side of the outer case, to thereby form a branch part between a second side end of the lower case and an end of the extended part of the upper case, to divide air flowing in the connection flow path into the circulation flow path and the bent flow path.

14. The vacuum cleaner according to claim 13, wherein the circulation flow path comprises a spiral flow path formed in a circumferential direction along an outer peripheral surface of the inner case from the branch part.

15. The vacuum cleaner according to claim 13, wherein the bent flow path comprises;

a first flow path communicated with the branch part while extending in a rear direction;

a second flow path communicated with the first flow path while being defined between a rear side of the inner case and a rear side of the outer case; and a third flow path communicated with the second flow path while extending in a front direction.

16. The vacuum cleaner according to claim 13, wherein air flow is branched at the branch part into a first air flow circulating along the circulation flow path and a second air flow bent along the bent flow path, the first air flow and the second air flow forming a combined flow combined and rising at an opposite side of the branch part around the inner case.

17. The vacuum cleaner according to claim 16, wherein the outer case comprises:

an outflow port formed at a rear upper portion to allow air to flow out therethrough, and the outflow port comprises:

a first partition positioned above the bent flow path, to prevent direct outflow of the second air flow through the outflow port, and a second partition positioned above the inner case to prevent direct outflow of the combined flow through the outflow port.

18. The vacuum cleaner according to claim 17, further comprises an air vent, wherein air guided along the discharge flow path is discharged to the outside of the vacuum cleaner through the air vent via the outflow port.

* * * * *

UNITED STATES PATENT AND TRADEMARK OFFICE

CERTIFICATE OF CORRECTION

PATENT NO. : 7,610,654 B2
APPLICATION NO. : 11/475965
DATED : November 3, 2009
INVENTOR(S) : Jea Won Lee et al.

It is certified that error appears in the above-identified patent and that said Letters Patent is hereby corrected as shown below:

Column 8, Line 12, change "comprises;" to --comprises:--.

Signed and Sealed this

Nineteenth Day of January, 2010

David J. Kappos

David J. Kappos
*Director of the United States Patent and Trademark Office*